US006886637B2

(12) United States Patent
Hervey et al.

(10) Patent No.: US 6,886,637 B2
(45) Date of Patent: May 3, 2005

(54) CYLINDER-STEM ASSEMBLY TO FLOATING PLATFORM, GAP CONTROLLING INTERFACE GUIDE

(75) Inventors: Donald G Hervey, Houston, TX (US); Robert H Carter, Houston, TX (US); Daniel Major Houser, Houston, TX (US)

(73) Assignee: Mentor Subsea Technology Services, Inc., Houston, TX (US)

( * ) Notice: Subject to any disclaimer, the term of this patent is extended or adjusted under 35 U.S.C. 154(b) by 0 days.

(21) Appl. No.: 10/600,131

(22) Filed: Jun. 19, 2003

(65) Prior Publication Data

US 2004/0256108 A1 Dec. 23, 2004

(51) Int. Cl.[7] ..... E21B 29/12

(52) U.S. Cl. ..... 166/355; 166/359; 166/345; 405/215; 405/224.1

(58) Field of Search ..... 166/350, 345, 166/359, 362, 355; 405/215, 224.2, 224.1; 114/264–267

(56) References Cited

U.S. PATENT DOCUMENTS 2,669,960 A * 2/1954 Laycock ..... 114/266
2,963,868 A * 12/1960 Armstrong ..... 405/200
4,934,870 A * 6/1990 Petty et al. ..... 405/199
6,161,620 A * 12/2000 Cox et al. ..... 166/367
6,260,625 B1 * 7/2001 Phan et al. ..... 166/355
6,263,824 B1 * 7/2001 Balint et al. ..... 114/264
6,347,912 B1 * 2/2002 Thomas ..... 405/224.2
6,352,116 B1 * 3/2002 Børseth ..... 166/359
6,375,391 B1 * 4/2002 Børseth et al. ..... 405/224.4
6,679,331 B2 * 1/2004 Cordy et al. ..... 166/367

* cited by examiner

*Primary Examiner*—Thomas Will
*Assistant Examiner*—Thomas A Beach
(74) *Attorney, Agent, or Firm*—D. Neil LaHaye; Eric Marich

(57) ABSTRACT

A cylinder-stem assembly to floating platform, gap controlling interface guide. A longitudinal wear strip and mating guide are positioned at an angle relative to a tangent to the nominally round exterior cylinder of the cylinder. Cylinder guides may be provided at more than a single elevation. The corners of the contacting surfaces of the wear strips may be rounded to reduce the risk of galling and to avoid any obvious point or line loading. During assembly, the cylinder-stem assembly is rotated after insertion into its slot in the floating platform. The rotation centers the cylinder and also may be used to control the magnitude of the gap or an interference fit.

8 Claims, 4 Drawing Sheets

CYLINDER-STEM ASSEMBLY TO FLOATING PLATFORM, GAP CONTROLLING INTERFACE GUIDE

BACKGROUND OF THE INVENTION

1. Field of the Invention

The invention is derived from consideration of risers in offshore floating structures, related more particularly to cylinder-stem assemblies for risers, and is generally applicable to the interfacing of any structure that can move within its supporting structure.

2. General Background

Cylinders such as buoyancy cans that function as tensioning devices for top-tensioned production and export risers have been used with conventional and truss-type spars and deep draft caisson vessels that serve as floating, deep-water, hydrocarbon drilling and/or production platforms. Buoyancy can tensioning could be used to tension risers for tension leg platforms (TLPs) but have not seen such use so far as is known. Prior buoyancy cans with stems have had four, six, or eight wear strips that contact guides supported in the hull and/or space frame (truss) of the floating platform. Such guides may contact wear strips not only on the buoyancy can but also on the upper stem and possibly lower stem that extend respectively above and below the buoyancy cans. Buoyancy can guides connected to the structure of such floating platforms have been either nominally round (toroidal) to contact the buoyancy can wear strips at any location or have been plates or other flat surfaces that are positioned nominally tangent to the exterior surface of the round (cylindrical) buoyancy can. Flat plate guides have been monolithically affixed to the structure of such floating platforms or have been supported with a cushion of compliant material such as an elastomeric material to soften impact loads caused by the relative movement between the buoyancy can and the floating platform. Alternatively, the compliant guide may have an interference fit so there is constantly a force of contact that may be sufficient to prevent separation of the wear strip and guide, thus eliminating impact forces (if it is sufficient) or at least rendering them much less frequent and severe.

SUMMARY OF THE INVENTION

The invention addresses the above needs. What is provided is a cylinder-stem assembly to floating platform, gap controlling interface guide. A longitudinal wear strip and mating guide are positioned at an angle relative to a tangent to the nominally round exterior cylinder of a structure such as a buoyancy can. Alternately, the interface guides could be positioned on the stems and omitted from the cylinder itself. Cylinder-stem assembly guides may be provided at more than a single elevation. The corners of the contacting surfaces of the wear strips may be rounded to reduce the risk of galling and to avoid any obvious point or line loading. During assembly, the cylinder-stem assembly is rotated after insertion into its slot in the floating platform. The rotation centers the cylinder and also may be used to control the magnitude of the gap or the magnitude of an interference fit.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
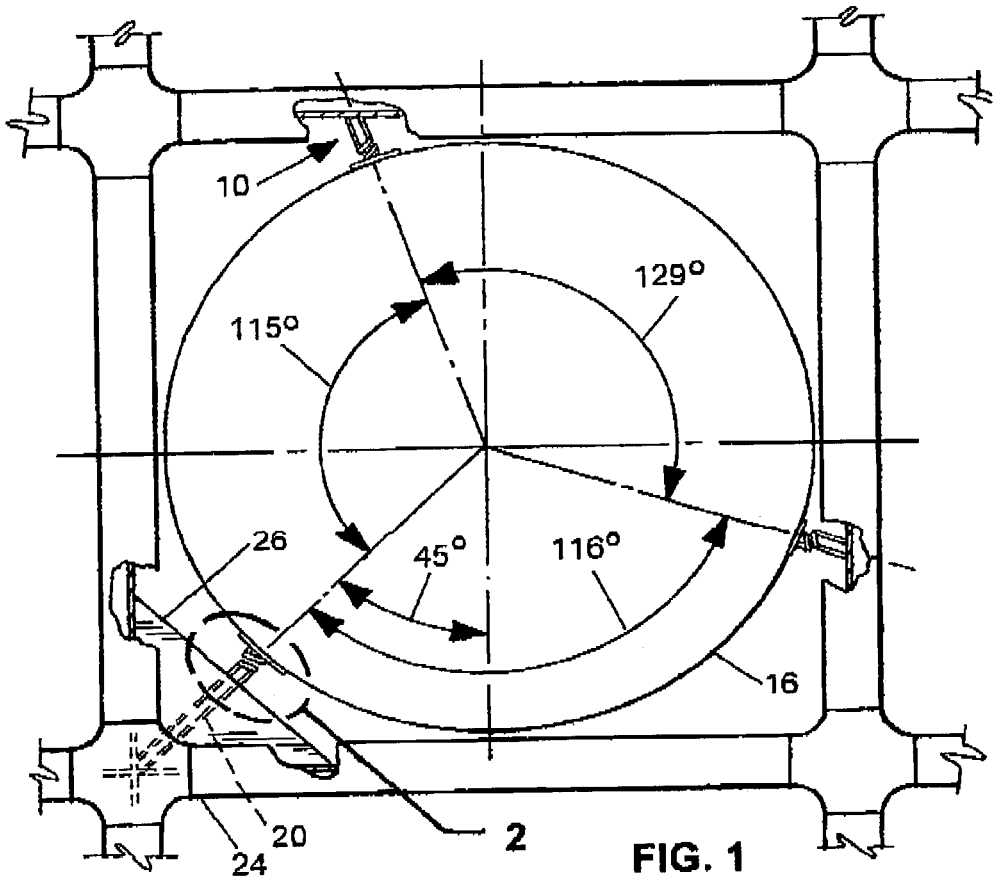
FIG. 1 is a plan view that illustrates the preferred embodiment of the installed invention.
Figure 3:
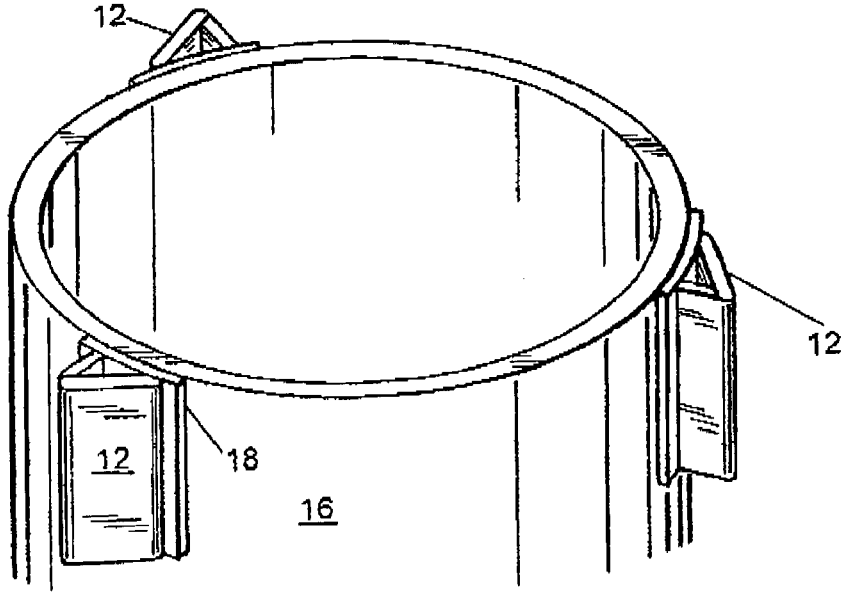
FIG. 3 is a perspective view of the wear strips on the cylinder.
Figure 2:
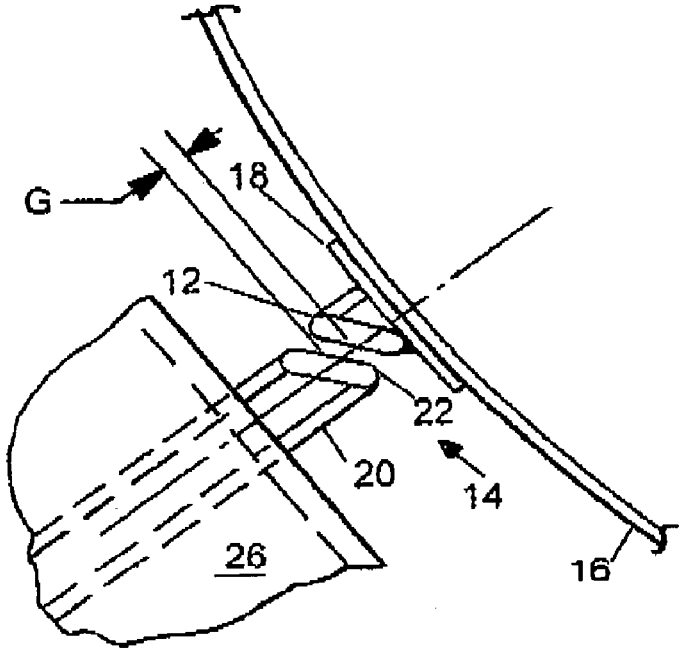
FIG. 2 is a detail view of the circled area indicated by the numeral 2 in FIG. 1.

Referring to the drawings, it is seen in FIG. 1-3 that the invention is generally indicated by the numeral 10. Gap controlling interface guide 10 is generally comprised of a wear strip 12 and a mating guide 14.

As best seen in FIGS. 2 and 3, the wear strip 12 is mounted on a cylinder 16 at an angle relative to a tangent to the exterior of the cylinder 16. The angle is determined by the need to cause closure of the gap between the wear strip and mating guide or engagement with more or less rotation of the cylinder-stem assembly. The stem, not shown, is coaxial with the cylinder and extends above the cylinder to enclose and protect the riser.

The wear strip 12 is rigidly attached to a plate 18 that is rigidly attached to the cylinder 16 by any suitable means such as welding. The corners of the surfaces on the wear strip 12 that contact the mating guide are preferably rounded to reduce the risk of galling and to avoid any obvious point or line loading.

As best seen in FIGS. 1 and 2, the mating guide 14 is formed from a support plate 20 and wear stop 22. The support plate 20 is rigidly attached to the center well framework 24 of the offshore structure. A gusset plate 26 is rigidly attached to the center well framework 24 and the support plate 20. The gusset plate 26 serves to retain the support plate 20 in its installed position.

In the preferred embodiment, three sets of wear strips 12 and mating guides 14 are provided at each elevation where they are required. However, more may be provided at any elevation if necessary. Generally, the tolerances will cause only three to be effective for centralizing the structure (cylinder or buoyancy can). The others may minimize deflection before contact and thus the magnitude of a dynamically interacting load.

Figure 4:
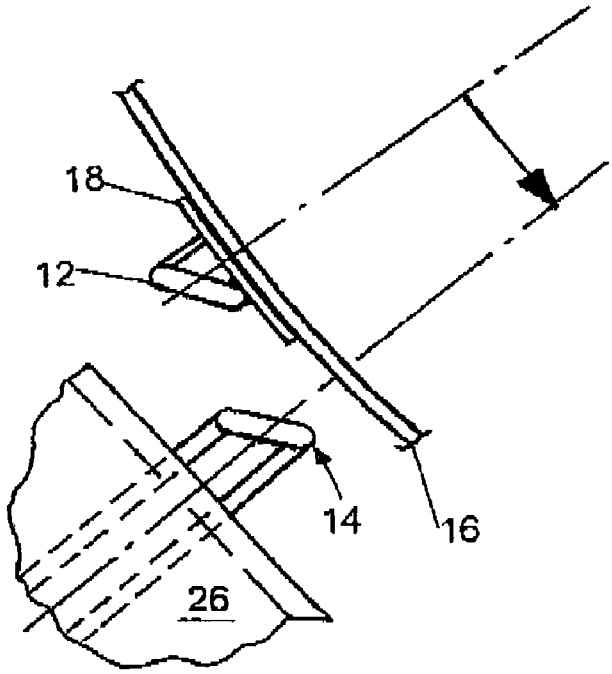
FIG. 4 illustrates the invention during installation of the cylinder.
Figure 5:
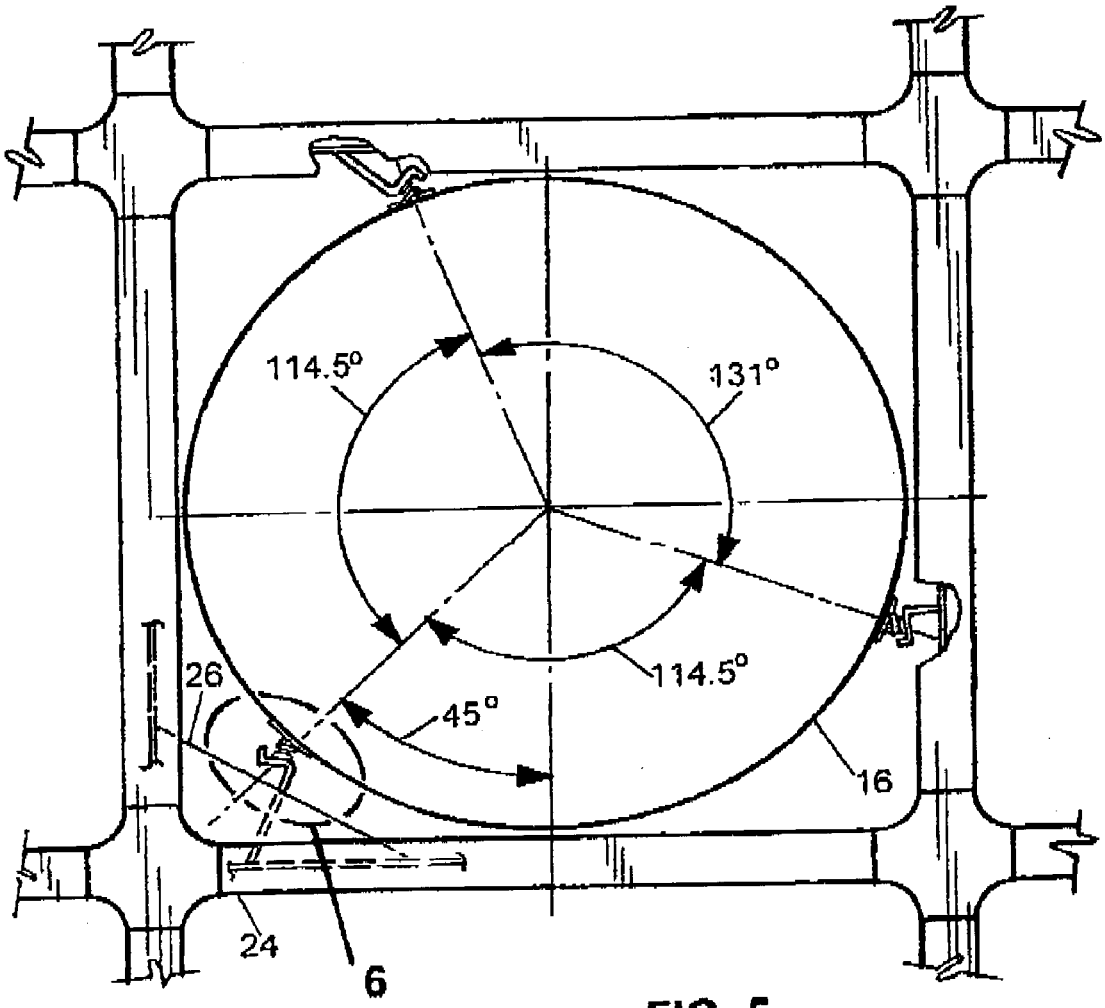
FIG. 5 is a plan view of an alternate embodiment of the invention.

In operation, the cylinder 16 and stem (not shown) are installed in the center well as illustrated in FIG. 4 such that the wear strips 12 on the cylinder 16 are at an elevation such that for all vertical positions of the cylinder-stem assembly there is sufficient area of interface with the mating guides 14 but not radially aligned with the mating guides 14.

During installation the cylinder 16 and stem are then restrained against vertical movement. The cylinder 16 and stem are then rotated until the wear strips 12 at the most critical elevation contact the corresponding wear stops 22 on the mating guides 14. This contact centers the cylinder 16 in position. The central axis of the cylinder and stem is then fixed using typical guide devices, for example at the lowest deck of the floating structure. If a gap is desired, the cylinder 16 and stem are then rotated in the opposite direction until the desired gap G between the wear strips 12 and wear stops 22 is achieved as illustrated in FIG. 2. If interference is desired, rotation continues in the original direction as may be predetermined by analysis.

Figure 7:
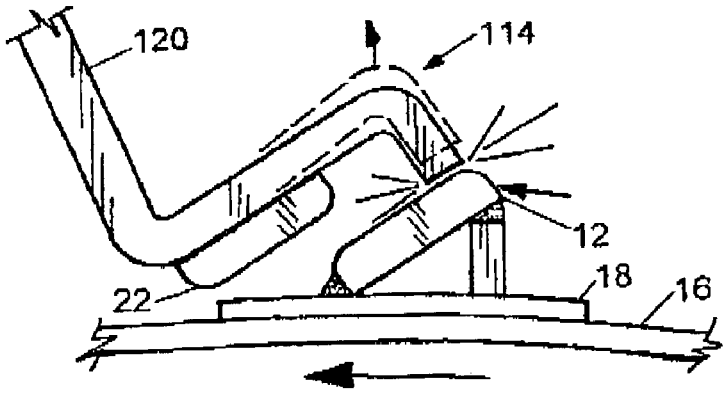
FIG. 7-9 illustrate the positioning of the alternate embodiment of FIG. 5 during installation of the cylinder.
Figure 8:
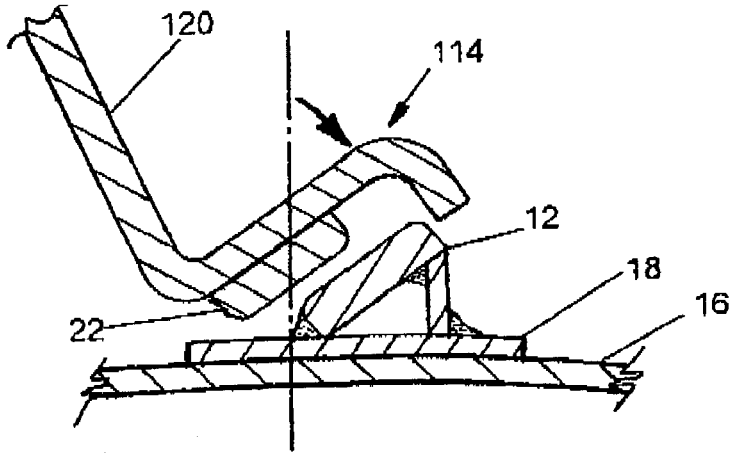
Figure 9:
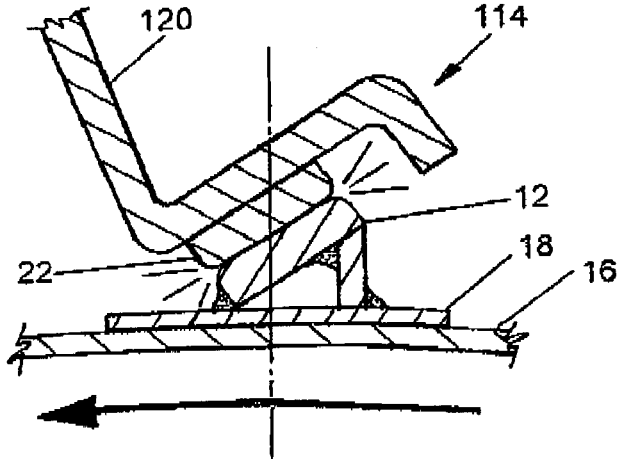
Figure 6:
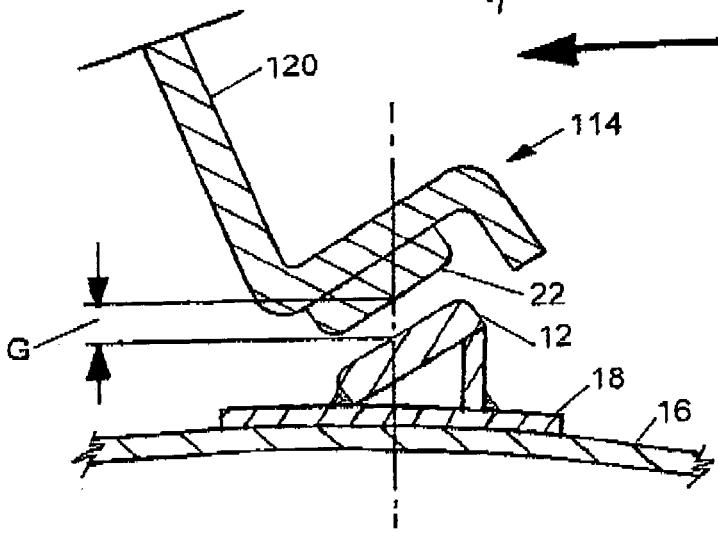
FIG. 6 is a detail view of the circled area indicated by the numeral 6 in FIG. 5.

FIG. 5-9 illustrate an alternate embodiment of the invention. Instead of a rigid mating guide 14 as in FIG. 1-4, a compliant mating guide 114 is provided. The end of the support plate 120 nearest the cylinder 16 is L-shaped to provide the necessary compliant characteristics. The wear stop 22 is attached to the side of the support plate facing the cylinder 16. During installation, the bottom portion of the L that forms the support plate 120 flexes to allow the wear strip 12 to move into position adjacent the wear strip 22 as seen in FIGS. 7 and 8. The cylinder 16 is rotated until the wear strip 12 and wear stop 22 make contact as seen in FIG. 9. The cylinder 16 and stem assembly are then rotated in the opposite direction to obtain the desired gap G as seen in FIG. 6. Alternately, the cylinder 16 and stem assembly may be rotated to create a desired interference.

The facing materials of the wear strip 12 and wear stop 22 may be made from any suitable material such as steel, ultra high molecular weight polyethylene, graphite, a low friction material such as polytetrafluoroethylene, etc.

It should be understood that the wear strips and mating guides are shown at only one elevation for ease of illustration and description. The wear strips and mating guides may be provided at more than one elevation along the cylinder-stem assembly.

The most critical elevation may be determined by dynamic riser analysis using finite element analysis software such as ABAQUS™. Subsequent establishing of tolerances and angles relative to a tangent for the different levels should ensure that the tightest fit will occur at the most critical elevation. To ensure engagement, the width of the wear strip, w, times the sine of the angle relative to the tangent must exceed the nominal magnitude of the gap with sufficient overlap to provide an area of contact to distribute the contact force. The width, w, should include consideration of fabrication tolerances, ovality of the cylinder, and possibly the life-time loss of material thickness of the wear strip due to wear and corrosion.

A problem solved by the invention is the control of the magnitude of the gap or clearance between the cylinder wear strip and its guide. This is accomplished by rotating the cylinder about its central axis. Large gaps are associated with larger impact loads that tend to use up the available fatigue life of the material of the cylinder and of the guides and their backing material in the hull. The result is an extension of facility life by controlling the magnitude of the gap to be ensured to be that for which the system is designed.

Another problem solved by the invention is that of altering the gap during the operating life of the cylinder. Should it be desired, the magnitude of the gaps on a cylinder may be changed during operations due to operational considerations. For example, such action could be desired to close the gaps because of cumulative wear (loss of material) or unacceptably large impact loadings. Alternately, such action could be taken to open the gap because of unacceptably frequent difficulty with the cylinder passively changing elevation relative to the floating platform, for example, because of unacceptably frequent slip-stick response inducing fatigue damage into the hull, the cylinder-stem assembly, and perhaps to a top tensioned riser supported by the cylinder.

Should there be a problem of excessive wear (loss of material) of the wear strip, the guides may be made so that they are removable so that preferential wear could occur on them and not on the cylinder wear strips.

Another problem solved by the invention is the maintenance of a specified contact force that may be induced by a torsional spring, for example, at the plus fifty-foot elevation for a spar structure. In such a case the force of contact need not change significantly due to variations in the tolerances of the system. The analysis must then address the torsional frequency and response of the system.

The invention is particularly suitable for use with buoyancy cans but is also useful to centralize items other than buoyancy cans.

The invention provides several advantages. It affords operational flexibility to adjust the gap between the wear strip of a cylinder such as a buoyancy can and its guide in a floating platform, not just at the time of installation, but at any time it is deemed to be advisable. This can be used to extend the useful life (fatigue life) of the structure. It could also be used to readjust the guide-wear strip gap when the floating platform is intentionally positioned in a manner that pulls down the cylinder and causes its wear strips to interface with the guides where the tolerance effects are different.

Another advantage is that the invention can ensure that there is a similar magnitude for the gap between the cylinder and the closest three guides affixed to the floating platform based on the tolerances and deviations from nominal of the actual, as-built facility. For omnidirectional seas, this will ensure similar fatigue life and wear of the wear strips for the three closest guides.

Another advantage is that the invention permits centralization of the axis of the cylinder stem based on the tolerances and deviations from nominal of the actual, as-built facility. This will enhance the fatigue life of the facility and minimize clashing potential between access/work platforms on the upper stems of the cylinders and between flexible jumpers or umbilicals atop a top-tensioned riser and the decks of the floating platform.

Another advantage is that the invention is the passive maintenance of a nearly constant force of contact that is effectively independent of local variations in system tolerances that include positional and angular tolerances of the wear strips, the guides, and the ovality of the cylinder. This may be accomplished by use of a "constant load" torsional spring to ensure the rotation of the cylinder-stem assembly to maintain contact with the guides.

Another advantage is that the invention can afford space to permit the use of replaceable guides affixed to the floating platform. Should compliant guides be desired based on operational considerations observed subsequent to the initial installation of the facility, this may be accomplished more economically than is possible on similar, existing structures.

Another advantage of the invention is that, should a specified nominal force of contact be desired, it can be applied and directly measured from the deck of the floating platform. Should such a floating platform have to be offset for drilling by the platform itself, e.g., on its moorings, or for drilling by a MODU, the offset will cause the nominal elevation of the cylinder to decrease. Then the nominal force could be applied (or gap be reset) for the tolerances about the new nominal, pulled down cylinder position. This causes the floating-platform-to-cylinder-stem assembly interface to perform as designed, extending the fatigue life and/or the performance of the facility.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In a floating offshore structure having a center well and a cylinder-stem assembly received in the center well for supporting a riser, a gap controlling interface guide, comprising:

a. a buoyancy cylinder attached to the upper portion of the riser;

b. a longitudinal wear strip mounted on the exterior circumference of said cylinder, said wear strip positioned at an angle relative to a tangent to the exterior of said cylinder; and c. a mating guide mounted in the center well of the floating offshore structure at an elevation such that for all vertical positions of the cylinder-stem assembly there is sufficient area of interface with said longitudinal wear strip and positioned at a complementary angle to said longitudinal wear strip such that the gap between said wear strip and mating guide is adjustable.

2. The gap controlling interface guide of claim 1, farther comprising a wear stop attached to said mating guide and facing said wear strip.

3. The gap controlling interface guide of claim 1, wherein said mating guide is non-compliant.

4. The gap controlling interface guide of claim 1, wherein said mating guide is compliant.

5. The gap controlling interface guide of claim 1, wherein at least three sets of said wear strips and mating guides are spaced around the circumference of said cylinder.

6. In a floating offshore structure having a center well and a cylinder-stem assembly received in the center well for supporting a riser, a gap controlling interface guide, comprising:

a. a buoyancy cylinder attached to the upper portion of the riser;

b. at least three longitudinal wear strips mounted on and spaced around the exterior circumference of said cylinder, said wear strips positioned at an angle relative to a tangent to the exterior of said cylinder; and c. a non-compliant mating guide mounted in the center well of the floating offshore structure at the same elevation as each of said longitudinal wear strips and positioned at a complementary angle to said wear strip such that the gap between said wear strips and mating guide is adjustable.

7. In a floating offshore Structure having a center well and a cylinder-stem assembly received in the center well for supporting a riser, a gap controlling interface guide, comprising:

a. a buoyancy cylinder attached to the upper portion of the riser;

b. at least three longitudinal wear strips mounted on and spaced around the exterior circumference of said cylinder, said wear strips positioned at an angle relative to a tangent to the exterior of said cylinder; and c. a compliant mating guide mounted in the center well of the floating offshore structure at an elevation such that for all vertical positions of the cylinder-stem assembly there is sufficient area of interface with each of said longitudinal wear strips and positioned at a complementary angle to said wear strip such that the gap between said wear strips and mating guide is adjustable.

8. The gap controlling interface guide of claim 7, further comprising a wear stop attached to aid mating guide and facing said wear strip.

* * * * *